US006814234B2

(12) United States Patent
Lipper

(10) Patent No.: US 6,814,234 B2
(45) Date of Patent: Nov. 9, 2004

(54) CARDBOARD/PAPERBOARD BOX WITH INTERNAL, REMOVABLE, TEMPORARY TATTOO

(76) Inventor: Christopher Lipper, 35 Buckley Hill Rd., Morristownship, NJ (US) 07960

( * ) Notice: Subject to any disclaimer, the term of this patent is extended or adjusted under 35 U.S.C. 154(b) by 150 days.

(21) Appl. No.: 10/268,616

(22) Filed: Oct. 10, 2002

(65) Prior Publication Data

US 2003/0080016 A1 May 1, 2003

Related U.S. Application Data

(60) Provisional application No. 60/328,393, filed on Oct. 10, 2001.

(51) Int. Cl.[7] ..... B65D 85/00
(52) U.S. Cl. ..... 206/459.5; 206/831
(58) Field of Search ..... 206/459.5, 931; 283/81, 97; 40/306, 310, 312; 428/195.1

(56) References Cited

U.S. PATENT DOCUMENTS 5,676,401 A * 10/1997 Witkowski et al. ..... 283/81
5,776,586 A * 7/1998 Lipper ..... 428/195.1
6,231,952 B1 * 5/2001 Lipper ..... 428/195.1
6,457,585 B1 * 10/2002 Huffer et al. ..... 206/459.5
6,594,927 B2 * 7/2003 Witkowski ..... 40/310
6,746,743 B2 * 6/2004 Knoerzer et al. ..... 428/42.1

* cited by examiner

*Primary Examiner*—Jacob K. Ackun, Jr.
(74) *Attorney, Agent, or Firm*—Law Offices of Royal W. Craig

(57) ABSTRACT

A cardboard/paperboard box for cereal, a child's toy, etc., that includes an integral removable tattoo, gemstone applique or other body art for promotional purposes (i.e. a premium play element or "gift with purchase"), is herein disclosed. In the preferred embodiment, the integral tattoo is formed on a multi-layer paper backing that is attached to the cardboard/paperboard box by a special pressure sensitive adhesive. The tattoo also includes a water soluble slip layer, a waterproof film coating, and an offset printed design such as a children's cartoon character, all carried on the backing.

12 Claims, 5 Drawing Sheets

CARDBOARD/PAPERBOARD BOX WITH INTERNAL, REMOVABLE, TEMPORARY TATTOO

CROSS-REFERENCE TO RELATED APPLICATIONS

The present application derives priority from U.S. provisional application No. 60/328,393 for "CARDBOARD/PAPERBOARD BOX WITH INTERNAL,REMOVABLE, TEMPORARY TATTOO"; Filed: Oct. 10, 2001.

BACKGROUND OF THE INVENTION

1. Field of the Invention

The present invention relates to packaging for consumables that incorporates promotional items and, more particularly, to cardboard/paperboard boxes that carry internal, integral removable tattoos as a "premium play element" for use by consumers, such as a children, for entertainment during or after consumption of the product contained therein.

2. Description of the Background

Product marketing can be a highly competitive process, especially when the target market is children. As an example of one effort to gain a competitive advantage, cereal manufacturers frequently include within the cereal box, in addition to the cereal, some form of premium play element or "gift with purchase" (GWP). Cereal GWP's have traditionally taken the form of children's toys/playthings such as action figures, rings, comics, trading cards, etc. The ability/opportunity to coordinate a GWP campaign with a trendy theme (e.g. "Pokemon", "Power Puff Girls", "Teletubbies", any of a number of Disney characters) often provides a company with huge gains in market share at the expense of its competitors. On the other hand, the economics of providing a GWP can be prohibitive in many situations. Action figures and the like can be expensive, and the simple logistics of incorporating a GWP inside a product container can be daunting in the context of a high-speed production process. The addition of the GWP in the production process takes more time, escalates manufacturing costs, and introduces potential bottlenecks into the process. In order to reduce the costs, there have been efforts at incorporating the GWP as an integral part of the package. For example, it is not uncommon these days to see bottle caps bearing action figures, cereal boxes with small toys included inside the box, etc. However, in the latter case the toy must be manufactured separately and then inserted into the box, thereby adding two more process steps. Obviously, if a cereal box can be manufactured at the outset with an integral GWP, then there is no need to interrupt the packaging process for the cereal.

One popular GWP category among young adults is "body art." Body art augments an individual's appearance through temporary and/or permanent tattoos, and jewelry items. However, most young children are not be allowed to obtain permanent body art (e.g., permanent tattoos or piercings). This actually increases the appeal of temporary body art such as, for example, a temporary tattoo that will eventually wash off. Temporary tattoos provide manufacturers of children's goods with a low-cost means of enhancing the entertainment value of their products. One example of a means for enhancing the entertainment value of products supplied in cylindrical cans/bottles is represented by U.S. Pat. No. 5,676,401 to Witkowski et al. That patent discloses a label that, in addition to carrying suitable advertising matter on its exterior surface (i.e. as applied on the can/bottle), carries on its interior surface one or more temporary transfer tattoos as premium play elements.

Despite the above, the present inventor is unaware of any equivalent means to incorporate a temporary tattoo as an integral part of a cardboard/paperboard box. This is primarily because the flexographic printing processes used for the tattoos versus the cardboard boxes differ widely. Accordingly, there exists a need to provide a means to attach one or more high quality, temporary tattoos to one or more inside surfaces of a cardboard/paperboard box without compromising structural integrity, and without significantly increasing the manufacturing costs.

SUMMARY OF THE INVENTION

In accordance with the above, it is the primary object of the present invention to provide a simple and inexpensive enhancement to a conventional cardboard/paperboard box in the form of an attachment comprising one or more integral removable tattoos, that is intended to influence consumers to purchase the enclosed product over competing products with conventional packaging.

It is another object of the present invention to provide removable tattoos, as premium play elements or "gifts with purchase", that are high quality simulations of actual, permanent tattoos.

It is another object to incorporate a temporary tattoo as an integral part of a cardboard/paperboard box, the container being produced in a single-pass flexographic printing process.

According to the present invention, the above-described and other objects are accomplished by providing one or more integral temporary tattoos that are integrally constructed as part of a cardboard/paperboard box as a GWP. The presently preferred tattoo box structure includes a die-cut paper board box printed and laminated on one side to convey ingredients, warranties, etc., in a conventional manner, and treated on the other side to adhere a temporary tattoo as an integral GWP. The side of the box bearing the temporary tattoo may also be printed in the tattoo area with application instructions, print advertising and the like, although this is an optional feature. Normally, tattoo application instructions are printed on the backside of the tattoo. Incorporation of the tattoo is accomplished by spot-laminating the untreated side of the die-cut paper board box with a water soluble slip layer, and then adhering a water resistant film on the water soluble slip layer. The water resistant film bears printed tattoo subject matter, and a layer of pressure sensitive adhesive covers the printed subject matter. Alternatively, a spot coating may be applied only over the printed design (rather than a water resistant film).

The tattoo construction may vary, and the invention can be accomplished using any variety of tattoo constructions. In any such case, the temporary tattoo is removable from the cardboard/paperboard box by a punch-out trading card defined by a line of perforations encircling the tattoo area on the die-cut paper board box. The present invention merges the removable tattoo production process with the fabrication of the cardboard/paperboard box in an economical way so as to make the product contained within more compelling, and to offer the tattoo(s) as a GWP.

BRIEF DESCRIPTION OF THE DRAWINGS

Other objects, features, and advantages of the present invention will become more apparent from the following detailed description of preferred embodiments and certain modifications thereof when taken together with the accompanying drawings in which.

DETAILED DESCRIPTION OF THE PREFERRED EMBODIMENTS

Figure 1:
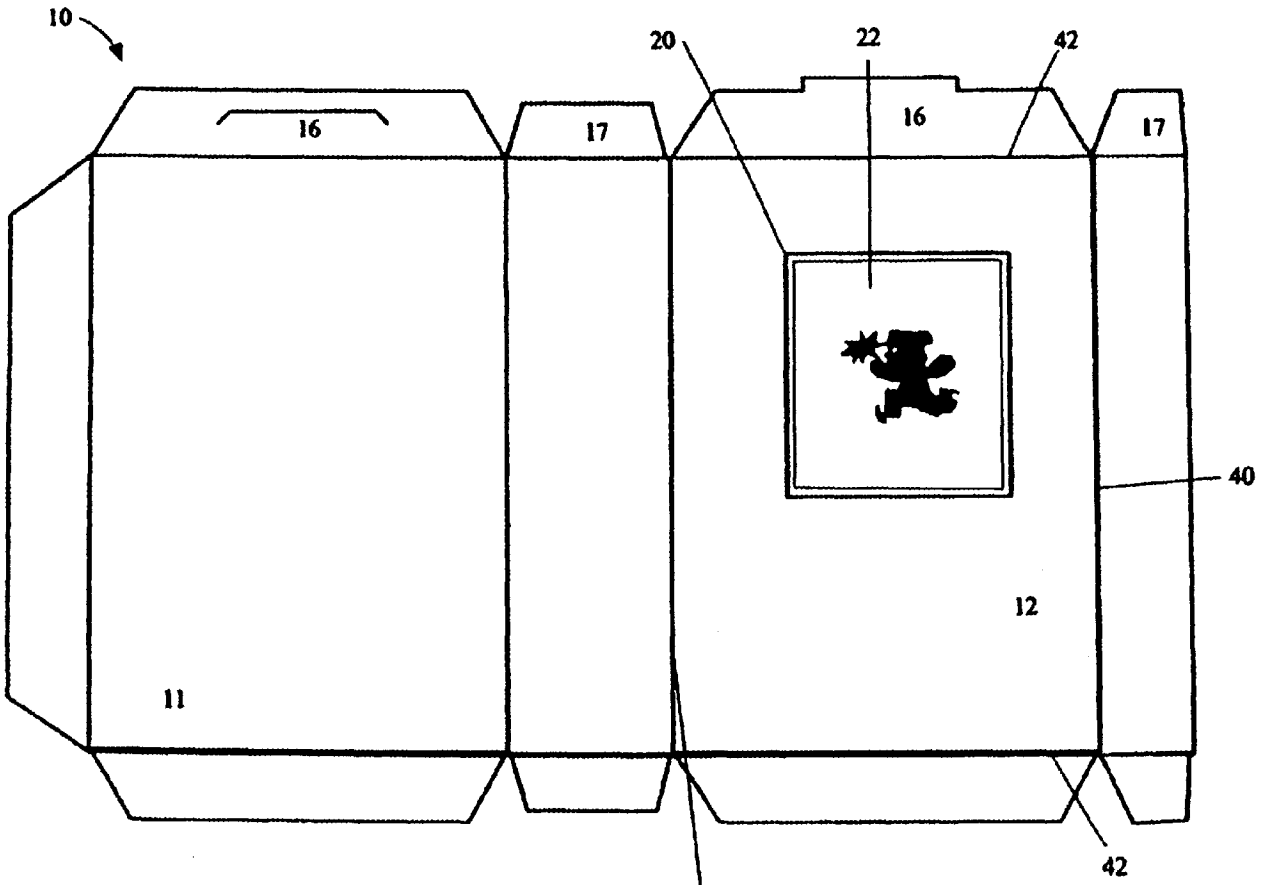
FIG. 1 is a perspective view of an exemplary die-cut cardboard/paperboard box 10, prior to folding and gluing, with an integral temporary tattoo 20 formed on the inner surface according to a first embodiment of the present invention.
Figure 2:
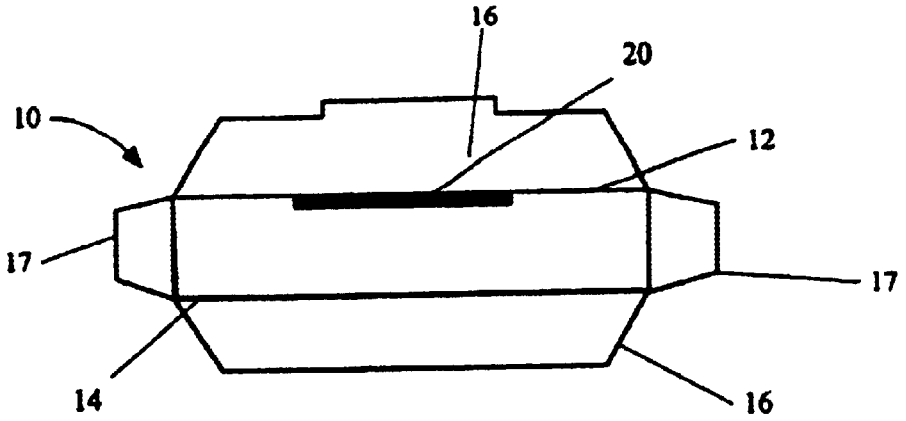
FIG. 2 is a top perspective view of an exemplary cardboard/paperboard box 10, after folding and gluing, with an integral temporary tattoo 20 attached to an interior surface 12.
Figure 3:
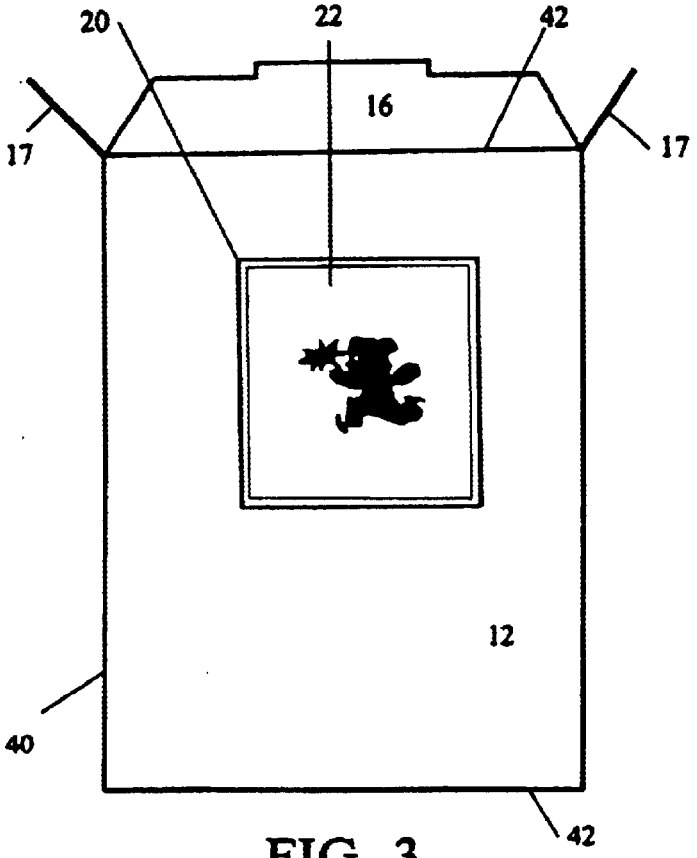
FIG. 3 is a front perspective view of an exemplary cardboard/paperboard box 10, after folding and gluing, with an integral temporary tattoo 20 attached to an interior surface 12.

FIG. 1 is a perspective view of an exemplary cardboard/paperboard box 10, prior to folding and gluing, with an integral temporary tattoo 20 formed thereon according to a first embodiment of the present invention. FIGS. 2 and 3 are, respectively, top and front perspective views of the cardboard/paperboard box 10 of FIG. 1, after folding/gluing and shown with the top major and minor flaps 16, 17 in the "open" position, with integral temporary tattoo 20 adhered on one of the inside surfaces.

The cardboard/paperboard box 10 of the present invention is utilized to enclose a product of some sort (e.g. cereal, a child's toy, etc.). Box 10 is formed from a conventional sheet 11 of cardboard/paperboard, and is scored and die cut from a roll of material in a conventional manner. Specifically, the sheet 11 is pre-die-cut in a conventional box pattern and is scored along a plurality of vertical axes 40 and a plurality of horizontal axes 42 to facilitate folding. The outside surface 14 (see FIG. 3) is printed and/or embossed to convey promotional information, consumer product information, and/or pricing information.

In accordance with the present invention, a temporary tattoo 20, bearing a fanciful design 22 (e.g. a Pokemon cartoon character), is integrally formed on the interior surface 12 of sheet 11 during the printing, cutting and scoring process (see FIGS. 1 and 2) as will be described.

To assemble the box 10, the sheet 11 is then folded along the scored axes 40, 42 and glued at key locations in order to create a three-dimensional box 10.

To gain access to the tattoo 20, the box's top major flaps 16 and top minor flaps 17 must be opened as seen in FIGS. 2 and 3.

The integral temporary tattoo 20 is integrally formed on sheet 11. One suitable process for making high quality, removable temporary tattoos is by securing an extremely thin, flexible, extensible design, closely simulating an actual tattoo, to an appropriate substrate. Specifically, U.S. Pat. No. 4,522,864 to Humason et al., entitled "Decals and Process for Making Same," discloses removable tattoos that include a multi-layer paper backing, a water soluble slip layer, a waterproof film coating, a lithograph offset printed design, and a transparent pressure sensitive adhesive. Removable tattoos of this type appear very bright, exciting and eye-catching.

Another suitable process is shown in U.S. Pat. No. 6,074,721 issued to Moore et al. and entitled "Temporary Tattoo Decals." In this case a spot coating is used only over the image (rather than a waterproof film coating), and the spot coating acts as a protective layer that keeps the contact adhesive from migrating to the surface of the decal after the finished temporary tattoo is applied to the skin.

Of course, there may be other acceptable processes for making temporary tattoos that would serve well for the present invention, and it would be apparent to those skilled in the art upon becoming familiar with said underlying concept that the invention can be accomplished with any variety of tattoo constructions. In any such case, the present invention merges the removable tattoo production process with the fabrication of the cardboard/paperboard box in an economical way so as to make the product contained within more compelling, and to offer the tattoo(s) as a GWP. The GWP/tattoo, after application by a user, may serve as additional publicity for the product contained within the cardboard/paperboard box.

Typical temporary tattoos formed in accordance with the above comprise a section of base paper which is conventional cardstock. The base paper is coated with a release base that dissolves when wet to allow detachment of the base paper from the functional (skin-attached) portion of the tattoo. A section of clear base (decal paper) is adhered by the release base to the base paper to provide a flexible skin-attachable. A colored ink design is printed atop the clear base (opposite the base paper) in mirror-image fashion. This way, when the clear base is applied to the skin of the wearer, the colored ink design layer shows upward there through and appears as a tattoo design.

For purpose of the present invention, generally, the cardboard/paperboard box in blank (sheet) form replaces the base paper, and a portion of the interior (non-laminated) surface of the cardboard/paperboard box is coated with the release base that dissolves when wet to allow detachment of the functional (skin-attached) portion of the tattoo. A colored ink design is printed atop the clear base (decal paper) in mirror-image fashion, and the printed section of clear base is adhered by the release base to the coated interior portion of the cardboard/paperboard box to provide a flexible skin-attachable tattoo. This way, when the clear base is removed and applied to the skin of the wearer, the colored ink design layer shows upward there through and appears as a tattoo design. Preferably, either during manufacturing of the cardboard/paperboard box blank, or during or after the tattoo deposition process, the cardboard/paperboard box blank is scored about a margin surrounding the coated release base to allow consumers to easily detach the scored section for more convenient application of the tattoo. The foregoing process effectively merges the removable tattoo production process with the fabrication of the cardboard/paperboard box. The production process is described in more detail below.

Figure 4:
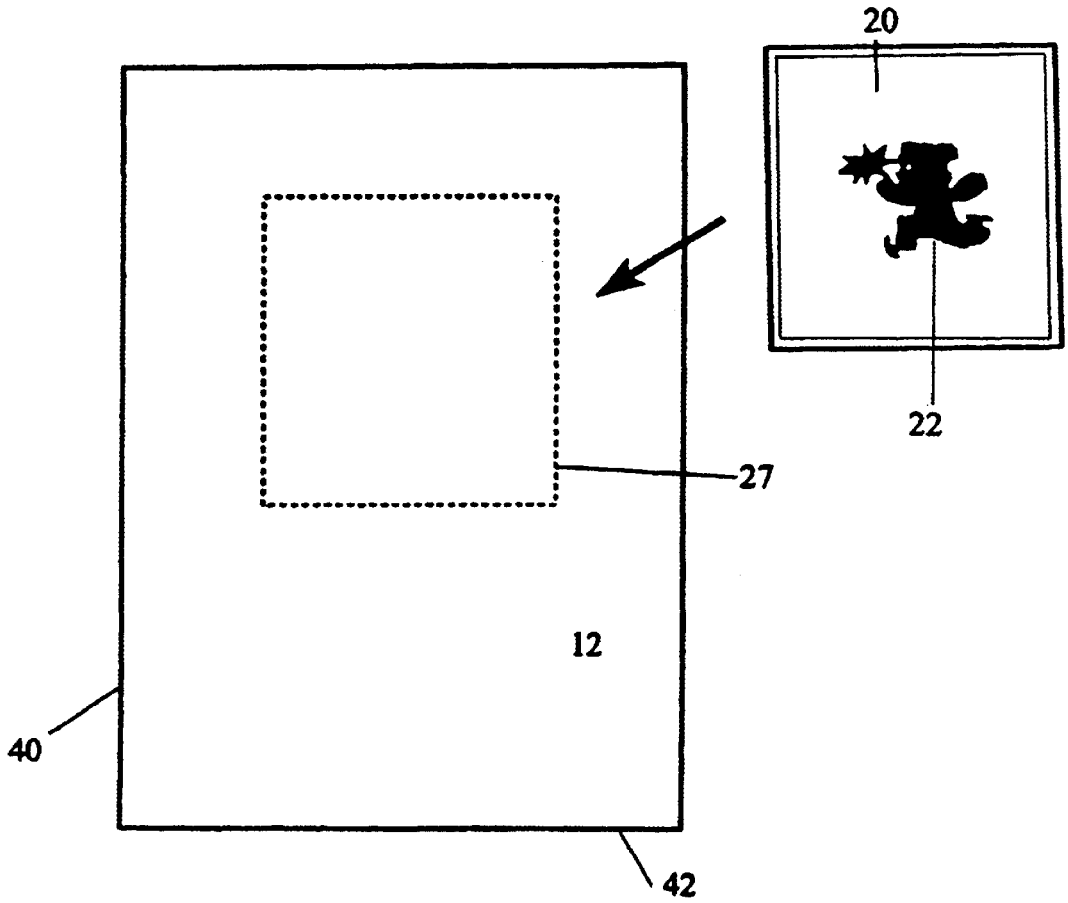
FIG. 4 is a break-away perspective drawing showing the temporary tattoo 20 removed from the interior surface 12 of the cardboard/paperboard box.

FIG. 4 is a break-away perspective drawing showing the temporary tattoo 20, bearing a fanciful design 22, removed from the interior surface 12 of the cardboard/paperboard box. As mentioned previously, the sheet 11 itself serves as a base decal paper. The box is scored with a line of perforations 27 which define a punch-out trading card encircling the tattoo area, as this facilitates removal of the tattoo 20 from the box. However, it should be understood that the perforation is an optional feature. In this manner, the perforated punch-out trading card inclusive of tattoo 20 can be removed from the box with tattoo intact (as shown) and ready to be applied by the user. Alternatively, a separate additional section of cardstock may be adhered to the interior surface 12 of the box using a specialized reattachable, and preferably non-toxic, bonding agent such as that which is commercially available from 3M Corporation®.

The interior surface 12 of the box in the area directly beneath the temporary tattoo is preferably printed with application instructions, license and manufacturing information, and even print advertising or the like. However, this additional printed material is an optional feature. Normally, tattoo application instructions will be printed on the backside of the sheet 11.

Figure 5:
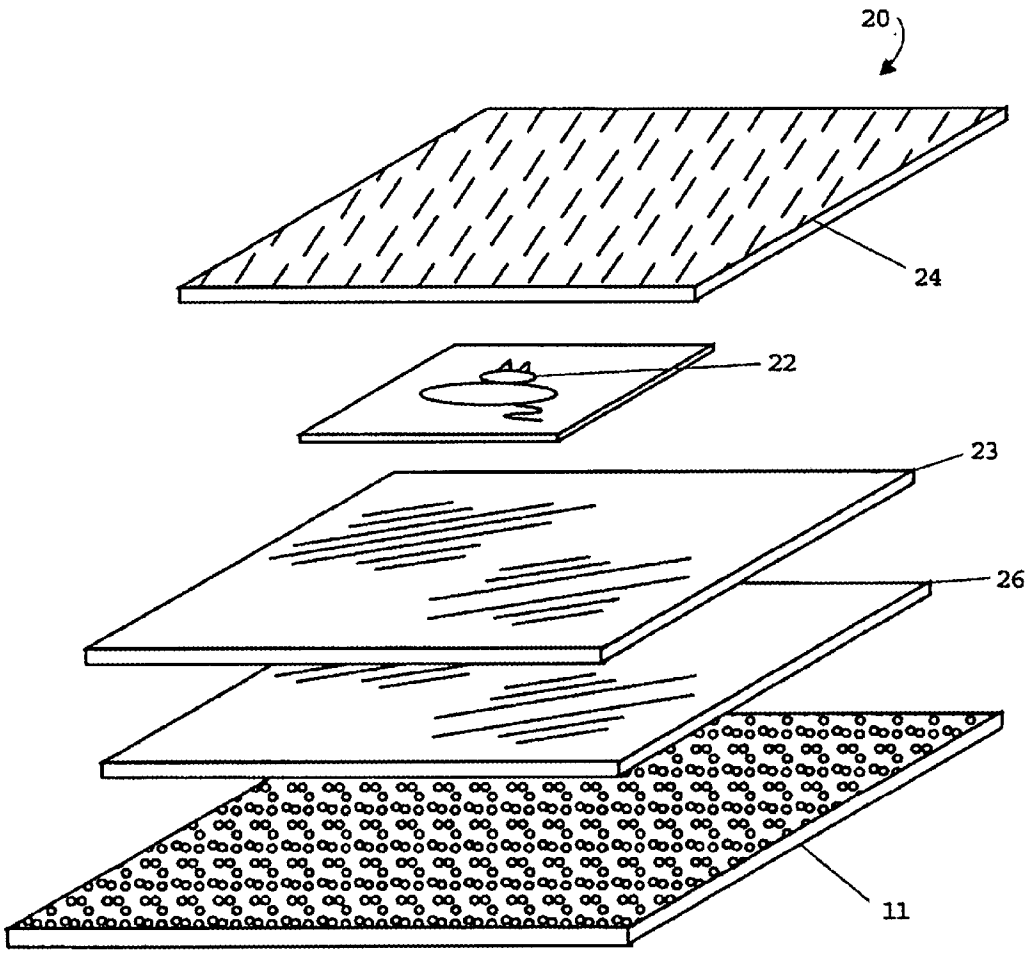
FIG. 5 is a side perspective drawing of the temporary tattoo 20 showing its constituent layers 22, 23, 24, 26, 28 separated from one another.

FIG. 5 is a side perspective drawing of the temporary tattoo 20 showing its constituent layers 22, 23, 24, 26, 28 separated from one another. The temporary tattoo 20 used in the present embodiment is a multi-color fanciful design 22 on an extremely thin, flexible, extensible film of water resistant material 23, which in turn covers a water soluble slip layer 26 carried on porous sheet 11. A uniform deposit of pressure sensitive adhesive 24 covers the design 22 and is adapted to hold the design against the surface to which it will be applied, and to protect it from disruption during application.

The temporary tattoo incorporated in the present invention, as shown in FIG. 5, lends itself to application to any flat surface including skin, and it closely simulates an actual tattoo by virtue of its extremely thin, flexible, extensible, matte surfaced film 23. A multi-color offset fanciful design 22 is imprinted on film 23. Printed design 22 comprises an extremely thin application of colored ink (or multiple applications for different colors) to thin film 23. The colored ink design preferably comprises non-toxic printing inks, and preferably any standard Food & Drug approved dyes such as FD&C yellow #5 aluminum lake, FD&C yellow #6 aluminum lake, FD&C blue #1 aluminum lake, FD&C red #7 aluminum lake, synthetic iron oxide pigment(black), and/or other inks of vegetable origin.

Pressure sensitive adhesive layer 24 is deposited on top of design 22 (on its printed side), and the above layers are supported by a water soluble slip layer 26 carried by sheet 11. Pressure sensitive adhesive layer 24 stays dry and is not tacky prior to application of the decal to the skin. Thus, when the tattoo 20 is applied to the interior surface 12 of the cardboard/paperboard box 10 (see FIG. 2), there is no adhesion of the pressure sensitive adhesive when contacted by any other items/product(s) contained within the box.

The film 23 and the imprinted design 22 are preferably as thin as possible. The sheet 11 and the slip layer 26 protect the film 23 and the lithograph design 22 until they are actually applied (e.g. to the skin of the user). The pressure sensitive adhesive 24 enables the printed film 23 to be secured in place while its integrity is protected by the sheet 11. Thereafter, the pressure sensitive adhesive layer 24 adheres the film 23 and the multi-color lithograph design 22 against the user's skin so that it is not disrupted during the wetting and removal of the paper 28 and the slip layer 26, or during the wiping off of any residual material. Further, the film 23 protects the printed design 22 during the time it is in place on the user's skin so that the skin surface and the applied film 23 and design 22 may be washed (it will withstand mild detergents such as soap). The film 23 and the design 22 may be removed when desired using an appropriate stronger solvent. Extreme thinness of the film 23 and the lithographed design 22 are important to make the film 23 less noticeable and to obtain the true appearance of a tattoo (i.e. where the color of the skin beneath the tattoo shows through and the design 22 seems to be part of the skin to which it is affixed). The thinness is also necessary to enable the film 23 and the design 22 to flex and stretch with the skin without cracking, and to minimize stresses tending to separate the film 23 and the design 22 from the skin through disruption of the pressure sensitive adhesive bond.

The design 22 is preferably formed by a multi-color offset lithograph process, thereby insuring a colorful attention-grabbing logo/advertisement. The slip layer 26 is formed by spraying or otherwise applying a coating comprising a solution of water soluble material to the base sheet of sheet 11, and then drying the slip layer 26. Slip layer 26 preferably comprises nonyl phenol polyoxyethylene sulfate and/or ammonium polyoxyethylene alkylphenylether sulfate. As will be described, the slip layer 26 preferably screen-printed onto the interior portion of the cardboard/paperboard box, and then the printed section of clear base is adhered by the release base to the coated interior portion of the cardboard/paperboard box, as the release base helps to prevent the colored ink from absorbing into the paper. The area of the sheet 11 coated by the slip layer 26 is preferably limited to the area which will receive the design 22. Thereafter, the coated area and, preferably the remaining area of the sheet 11 are coated lithographically with a very thin film 23 of a water resistant, flexible, extensible material. The film is microscopically thin, preferably no thicker than necessary to resist penetration of water to the slip layer 26 and the sheet 11. A suitable film material is the material commercially available as a standard "offset overprint varnish," but other natural or synthetic materials, such as resin solutions having the necessary covering and water resistant properties, may be used. The printing of a selected design 22 may employ normal procedures for multi-color offset printing. The film 23 protects the water soluble slip layer 26 against any wetting agent to which the sheet 11 may be exposed during the printing process, and protects the paper 28 against curling from exposure to printing agents. The pressure sensitive adhesive 24 is next applied over the printed design 22. A preferred adhesive is an aqueous emulsion of vinyl-acrylic copolymer, and a variety of suitable adhesives are commercially available. It is important that the adhesive layer 24 be uniform. It has been found that an adhesive layer 24 having superior characteristics in the present invention is secured by applying the emulsion using a silk screen procedure. The adhesive is deposited in a thin, extremely uniform, substantially invisible layer, which, after drying, does not cause perceptible visual interference between the design and the surface to which the tattoo is secured.

The simple and inexpensive design of the temporary tattoo 20 allows the attachment of an extremely thin and flexible design, logo, or the like to a flat surface such as skin in order to simulate an actual tattoo. More importantly, all of the foregoing layers of the temporary tattoo 20 may be deposited on sheet 11 at the time of printing the sheet 11. Thus, inclusion of the temporary tattoo 20 does not significantly increase the cost of manufacturing the cardboard/paperboard box.

To apply the finished tattoo 20, the tattoo 20 is detached from the cardboard/paperboard box 10 by tearing sheet 11 along perforations 27, and water is applied directly to the sheet 11 to wet it and to soften or dissolve the slip layer 26. The sheet 11 and any residue is removed, leaving the design 22 in place.

The tattoo 20 as described above helps to convey a multi-level marketing message that was not previously possible. First, the cardboard/paperboard box 10 conveys product promotional information in a conventional manner. Second, the tattoo 20 conveys a second level print design for promotional purposes. Moreover, since the tattoo 20 must be removed from the ox, the tattoo 20 draws attention to the inside of the box. Consequently, it becomes practical to print a third level of promotional material on the inside surface of the box because the consumer will see it.

Although the above-described embodiment is illustrated in the context of a particular tattoo 20 construction, it should be understood that other tattoo constructions may serve as well and are considered to be within the spirit and scope of the present invention.

Figure 6:
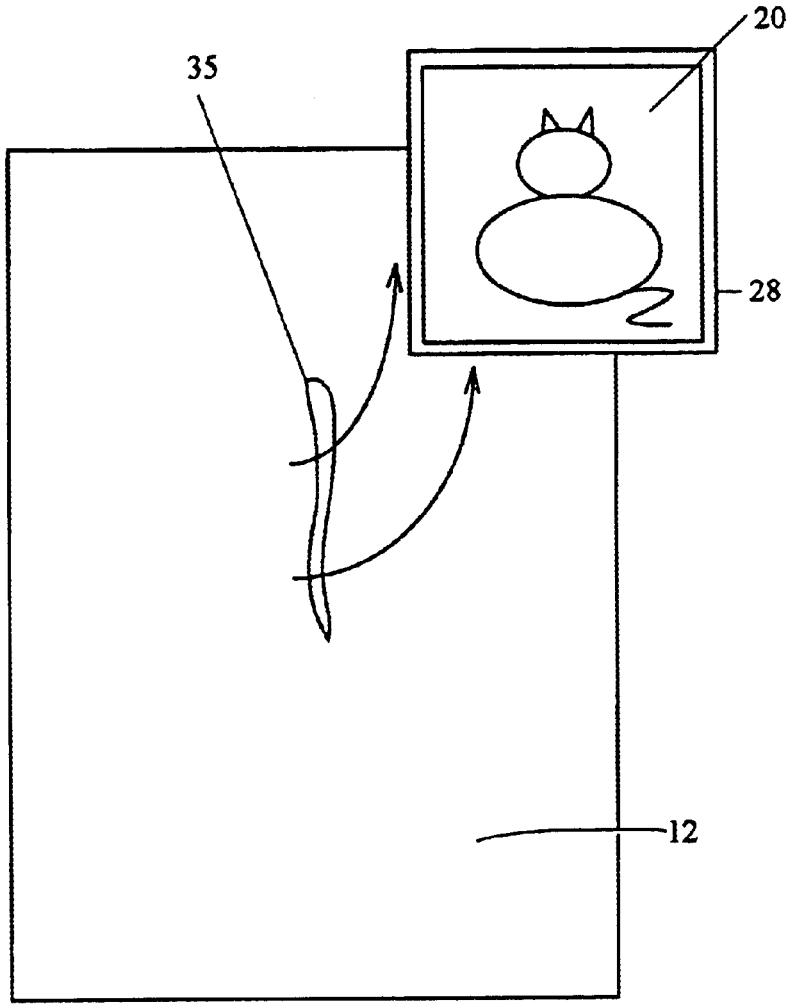
FIG. 6 is a perspective view illustrating another manner of attaching the temporary tattoo 20 to the cardboard/paperboard box.

For example, FIG. 6 is a perspective view illustrating another manner of attaching the temporary tattoo 20 to the cardboard/paperboard box. Here the tattoo 20 is provided with its own base piece of decal paper 28, and is attached thereby to the interior surface 12 of the box using the above-described reattachable bonding agent 35. Preferably, the reattachable bonding agent 35 is applied to the back side of the sheet 11 along one edge for removably attaching that edge of the removable tattoo 20 to the interior surface 12. The bonding agent may be applied linearly (as shown), or at one or more points along the edge of the sheet 11. The bonding agent may be applied directly to the interior surface 12, or it may be provided separately as a strip of tape for insertion between the sheet 11 and the surface 12. In all cases, this edgewise application makes it possible to raise the opposing free end of the tattoo 20 while the bonded edge remains attached to the interior surface 12. Printed subject matter (e.g. tattoo application instructions, tattoo collector series information) can be included on the surface 12 underneath the tattoo 20. While this information is obscured by the tattoo, it is revealed when the opposing free end of the tattoo 10 is raised. Such information has more visual impact and is more closely associated with the tattoo when is positioned underneath and revealed by the lifting of the tattoo 20. Moreover, the edgewise application of the bonding agent 35 is important inasmuch as the tattoo 20 can be more easily removed from the surface 12 without destroying the tattoo 20 or any underlying print.

Having now fully set forth the preferred embodiments and certain modifications of the concept underlying the present invention, various other embodiments as well as certain variations and modifications of the embodiments herein shown and described will obviously occur to those skilled in the art upon becoming familiar with said underlying concept.

For example, in addition to the inked tattoo design, the tattoo may be an integral removable gemstone applique (tattoo), or an integral removable temporary printed tattoo with gemstone adornments, both as set forth in co-pending application Ser. No. 09/861,474 filed May 18, 2001 and herein incorporated by reference.

It is to be understood, therefore, that within the scope of the appended claims, the invention may be practiced otherwise than as specifically set forth herein.

I claim:

1. A cardboard/paperboard box with internal, integral removable tattoo, comprising:

a cardboard/paperboard box having at least one interior surface suitable for attachment of a removable tattoo; and a removable tattoo displaying printed matter, said tattoo further comprising;

a water soluble slip layer carried on one side of said cardboard/paperboard box;

a water resistant film carried on said water soluble slip layer;

secondary printed matter on said water resistant film;

a layer of pressure sensitive adhesive covering the printed matter; and a reattachable bonding agent adhering said removable tattoo to said cardboard/paperboard box along an edge of said removable tattoo for removable attachment to said interior surface;

whereby said removable tattoo represents a premium play element or a "gift with purchase" associated with a product contained within said cardboard/paperboard box, which may be removed and applied elsewhere to provide entertainment for a user, or further publicity for said product.

2. The cardboard/paperboard box with internal, integral removable tattoo according to claim 1, wherein said box is formed from a cardboard/paperboard sheet that is die cut from a roll or sheet of material possessing a first side that is substantially blank and a second side bearing printed information associated with said product.

3. The cardboard/paperboard box with internal, integral removable tattoo according to claim 2, wherein said cardboard/paperboard sheet is folded along a plurality of vertical and horizontal axes to create a three-dimensional box having at least four sides, exterior surfaces bearing said printed information, and substantially blank interior surfaces for attaching one or more said removable tattoos.

4. The cardboard/paperboard box with internal, integral removable tattoo according to claim 2, wherein said cardboard/paperboard sheet is rolled to create a three-dimensional cylindrical box having an exterior surface bearing said printed information, and a substantially blank interior surface for attaching one or more said removable tattoos.

5. The cardboard/paperboard box with internal, integral removable tattoo according to claim 2, wherein the attached tattoo obscures secondary printed matter until removed.

6. The cardboard/paperboard box with internal, integral removable tattoo according to claim 1, wherein said printed matter comprises a multi-color offset print graphic printed on said water resistant film.

7. The cardboard/paperboard box with internal, integral removable tattoo according to claim 6, wherein said slip layer corresponds to an area occupied by said graphic.

8. The cardboard/paperboard box with internal, integral removable tattoo according to claim 7, wherein said water resistant film covers substantially the entire area of said decal paper.

9. The cardboard/paperboard box with internal, integral removable tattoo according to claim 8, wherein said water resistant film is matte surfaced.

10. The cardboard/paperboard box with internal, integral removable tattoo according to claim 1, wherein said interior surface of said cardboard/paperboard box contains print matter in an area directly beneath the temporary tattoo.

11. The cardboard/paperboard box with internal, integral removable tattoo according to claim 10, wherein said print matter comprises application instructions.

12. A cardboard/paperboard box with internal, integral removable tattoo, comprising:

a cardboard/paperboard box having at least one interior surface suitable for attachment of a gemstone applique; and a removable gemstone applique, said gemstone applique further comprising;

a water soluble slip layer carried on one side of said cardboard/paperboard box;

a water resistant film carried on said water soluble slip layer;

a plurality of gemstones on said water resistant film;

a layer of pressure sensitive adhesive covering each of the plurality of gemstones; and a reattachable bonding agent adhering each of the plurality of gemstones to said cardboard/paperboard box for removable attachment to said interior surface;

whereby said gemstone applique represents a premium play element or a "gift with purchase" associated with a product contained within said cardboard/paperboard box, which may be removed and applied elsewhere to provide entertainment for a user, or further publicity for said product.

* * * * *